US005557546A

United States Patent [19]

Fukai et al.

[11] Patent Number: 5,557,546

[45] Date of Patent: Sep. 17, 1996

[54] DATA ACQUISITION SYSTEM FOR THE ANALYSIS OF ELEVATOR TROUBLE

[75] Inventors: Hisanori Fukai; Hiroshi Yamazaki; Kenji Kawano; Shinichiro Kawano; Hajime Okamoto, all of Tokyo, Japan

[73] Assignee: Hitachi Building Systems Engineering & Service Co. Ltd., Japan

[21] Appl. No.: 208,307

[22] Filed: Mar. 10, 1994

[30] Foreign Application Priority Data

Mar. 26, 1993 [JP] Japan ..... 5-068334

[51] Int. Cl.[6] ..... B66B 5/02

[52] U.S. Cl. ..... 364/551.01; 364/148; 187/391; 187/393; 340/825.06; 340/825.16; 340/529

[58] Field of Search ..... 364/580, 184, 364/148, 554, 551.01; 187/124, 29 R, 247, 391, 393; 340/825.06, 825.07, 825.08, 825.16, 825.5, 825.52, 825.53, 527, 529; 370/85.1, 85.2

[56] References Cited

U.S. PATENT DOCUMENTS

| | | | |
|---|---|---|---|
| 3,973,648 | 8/1976 | Hummert et al. | 187/29 R |
| 4,330,838 | 5/1982 | Yoneda et al. | 364/580 |
| 4,401,192 | 8/1983 | Trosky et al. | 364/551.01 |
| 4,697,243 | 9/1987 | Moore et al. | 364/184 |
| 4,703,325 | 10/1987 | Chamberlin et al. | 364/551.01 |
| 4,727,499 | 2/1988 | Tsuji | 364/554 |
| 4,750,591 | 6/1988 | Coste et al. | 187/393 |
| 4,771,865 | 9/1988 | Hinderling | 187/391 |
| 4,930,604 | 6/1990 | Schienda et al. | 187/393 |
| 5,010,472 | 4/1991 | Yoneda et al. | 364/148 |
| 5,027,299 | 6/1991 | Uetani | 364/580 |
| 5,042,620 | 8/1991 | Yoneda et al. | 187/124 |
| 5,064,026 | 11/1991 | Nagata et al. | 187/391 |
| 5,139,113 | 8/1992 | Mizuno et al. | 187/393 |
| 5,257,176 | 10/1993 | Uetani | 364/148 |
| 5,431,252 | 7/1995 | Morrison | 187/391 |
| 5,445,245 | 8/1995 | Ketoviita | 187/391 |

FOREIGN PATENT DOCUMENTS

| | | | |
|---|---|---|---|
| 2928463 | 2/1981 | Germany . | |
| 4-201963 | 7/1992 | Japan | 187/393 |
| 5-201641 | 8/1993 | Japan | 187/393 |
| 2226428 | 6/1990 | United Kingdom | 187/393 |

*Primary Examiner*—Ellis B. Ramirez
*Assistant Examiner*—Eric W. Stamber
*Attorney, Agent, or Firm*—Evenson, McKeown, Edwards & Lenahan P.L.L.C.

[57] ABSTRACT

Operational data of an elevator are constantly and successively stored in RAM of a terminal supervisor unit. If the elevator develops a malfunction which lasts for a predetermined time, this malfunction is detected and reported from the terminal supervisor unit to a supervisor center, together with relevant data, such as the place of occurrence of the malfunction, the code number of the elevator in question and the kind of malfunction. The data relevant to the malfunction are collected at a time point when predetermined specific data indicate that a malfunction is likely. For this purpose, malfunction-indicating states of the specific data are preset and stored in a preset value storage unit, for each possible kind of malfunction, and are constantly compared with the corresponding actual data. By collecting relevant data before actual determination of a malfunction, an investigation for a cause of the malfunction through an analysis of data can be performed more accurately.

6 Claims, 5 Drawing Sheets

DATA ACQUISITION SYSTEM FOR THE ANALYSIS OF ELEVATOR TROUBLE

BACKGROUND OF THE INVENTION

1. Field of the Invention

This invention relates to a data acquisition system for collecting data which are useful for the analysis of a malfunction of an elevator.

2. Description of the Related Art

An elevator installed in a building is essential ascending and descending means for the residents of the building and also for visitors to the building. If the elevator fails or malfunctions, their daily life will be crippled, with a potential danger of fatal accidents. To prevent such an elevator malfunction, and if it occurs, to promptly eliminate it, a building with an elevator installed therein is provided with a terminal supervisor unit connected to a control system for the elevator and the terminal supervisor unit is in turn connected via a telephone line or network to a supervision center of an elevator maintenance services company. The terminal supervisor unit constantly receives and stores data indicative of the state of operation of the elevator from the control system for the elevator and based on the operational state data so received, determines any malfunction. If a serious malfunction occurs, the terminal supervisor unit additionally stores data which have been relied upon for the determination of the malfunction, and transmits via the telephone line or network the thus-stored additional data along with the place of the occurrence of the malfunction, the code number of the elevator in question and the kind of the malfunction to the supervision center.

Upon receipt of a report of such a malfunction from one or more of terminal supervisor units for a number of elevators under supervision, on the other hand, the supervision center dispatches a maintenance service man or crew to each site, as needed, to eliminate the malfunction. In addition, the cause of the malfunction is analyzed based on the received data and is used as a reference or guide for future maintenance work in order to avoid occurrence of the same difficulty.

In the conventional terminal supervisor unit described above, a particular malfunction is determined to have occurred when a set of data relevant thereto have assumed predetermined states, respectively. If passenger(s) are confined to an elevator car, for example, there are inputted, as data which determine such a malfunction, "passenger(s)" data (i.e., data on whether or not there are passengers(s) in the car), "sudden stop during running" data (i.e., data on whether or not the car suddenly stopped during running" and "time" date (i.e., data on whether or not a predetermined time has elapsed subsequent to the sudden stop). If these data indicate "passenger(s) in (the car)", "suddenly stopped" and "30 seconds elapsed" a passenger trapped malfunction is determined to have occurred. At the time point of this determination, relevant data are additionally stored.

The operation of the above prior art device in the case of a trapped passenger malfunction will be described with reference to time charts illustrated in FIGS. 1 and 2, respectively. Observing the situation at time $t_1$ in FIG. 1, there is neither "passenger detection" nor "sudden stop during running". The situation therefore does not meet the conditions described above. Whereafter, at time $t_2$, the situation of "passenger(s) in (the elevator)" and "suddenly stopped during running" have arisen so that at this time $t_2$, a timer begins to count the time. When 30 seconds have elapsed since that time as counted by the timer ("30 seconds elapsed") and time $t_3$ is hence reached, the situation of "passenger(s) in (the elevator)" "suddenly stopped during running" and "30 seconds elapsed" has arisen so that a caging-in trouble is determined to have occurred. In response to this determination, in addition to the data of "passenger(s) in (the elevator)" and "suddenly stopped during running", relevant data at this time are collected and are once stored in a storage unit.

Incidentally, the purpose of interposing the time interval (for example, 30 seconds) since the occurrence of "suddenly stopped during running" until the determination of occurrence of the trouble is to corroborate the occurrence of a malfunction. For example, although the elevator is in order, the data of "passenger(s) in (the elevator)" and "suddenly stopped during running" may occur for certain reasons or at the moment that a power supply is turned on, such data may occur. The data however do not last for more than a certain time in such a case. The interposition of 30 seconds therefore makes it possible to avoid erroneous malfunction reporting.

FIG. 2 partially illustrates the relevant data (referred to above) at time $t_3$. In FIG. 2, "running corroboration" represents a signal indicating whether or not the car is running whereas brake designates a signal indicating whether or not a brake has been applied. On the other hand, "open zone detection" means a signal indicating whether or not the car is located within a zone of a vertical shaft (i.e., open zone) which is preset on both upper and lower sides of the floor of each elevator hall to permit opening of the door within the zone. "Open door detection" denotes a signal indicating whether or not the door has been opened (the hatching indicates that the door is open). Further, the "safety device actuation" designates a signal indicating whether or not a safety device such as a governor switch provided for the detection of any abnormal speed of the car or a final limit switch provided for the detection of passage of the car beyond a top floor or a bottom floor has been actuated (the hatching indicates that the safety device has been actuated). It is apparent that these signals shown in FIG. 2 are only a portion of the many types of data which may be collected. As is evident from the time chart, the relevant data to be stored are the "open door detection" data and the "safety device actuation" data.

The data stored as described above are transmitted to the supervision center, along with data such as the place of the occurrence of the malfunction, the code number of the elevator in question and the nature of the malfunction. By analyzing the thus-transmitted data in detail, it is possible to use them for the investigation of the cause of the problem and based on the investigation, to establish a measure for the prevention of occurrence of the same malfunction in the future.

Although a malfunction may occur suddenly, a certain sign of the malfunction is observed beforehand in many instances. In this case, the data transmitted as described above are insufficient for the more accurate investigation of the cause of the malfunction because they consist of only the data which were employed for the determination of the malfunction at the time when it was determined to have occurred. That is, relevant diagnostic information based on events which occurred before the malfunction was determined to exist are not transmitted or available.

SUMMARY OF THE INVENTION

The present invention has been completed in view of the above-described drawback of conventional acquisition of data at the time of determination of a malfunction. An object of the present invention is therefore to provide a data acquisition system for the analysis of an elevator failure, which makes it possible to more accurately investigate the cause of malfunction.

To achieve the above-described object, the present invention provides a data acquisition system for analyzing elevator malfunction, of the type which has an operational data storage unit for storing operational data of the elevator, malfunction determination means for corroborating and determining the malfunction of the elevator on the basis of plural specific data read from said operational data storage unit, and means for collecting data, relevant to the malfunction, from the operational data storage unit when the trouble has been determined true by the trouble determination means. (The operational data storage unit, the trouble determination means and the data collection means are all arranged in a terminal supervisor unit connected to a supervision center for supervising said elevator via a telephone line.) In particular, the data acquisition system according to the invention has:

a preset value storage unit for presetting and storing a malfunction-indicating state with respect to at least one of said specific data; (as explained in greater detail hereinafter), the term "malfunction-indicating state" means a defined set of one or more conditions the occurrence of which indicates that although a malfunction has not yet been determined to exist, such a determination of a malfunction is likely to occur soon. For example, certain conditions indicative of a particular malfunction may be occurring but have not yet existed for a sufficient time to determine that an actual malfunction is in fact the cause.

data collection trigger means for actuating the data collection means when the specific data stored in the operational data storage unit match the data preset for the determination of the malfunction-indicating state, whereby predetermined data of the operational data storage unit at that time are read.

In the above construction of the present invention, the malfunction-indicating state preset in the preset value storage unit can preferably be preset in the preset value storage unit from the supervision center via the telephone line.

According to the construction described above, a malfunction-indicating state is preset at the preset value storage unit with respect to at least one of the specific data employed for the determination of the malfunction. As soon as the trouble-indicating state occurs on said at least one of the specific data, the data collection trigger unit is actuated to drive the data collection unit. From the operational data storage unit in which operational data of the elevator are stored, the data relevant to the malfunction are then read by the data collection unit prior to the determination of the malfunction by the malfunction determination means.

It is therefore possible to more accurately analyze the occurred malfunction by changing the specific data employed for the determination of the malfunction. This makes it possible to accurately conduct an investigation of the cause of the problem and hence to conduct appropriate maintenance work.

Where the malfunction-indicating state of at least one of the specific data is preset in the preset value storage unit, it is preferred to preset the malfunction-indicating state from the supervision center as described above. In this case, it is possible to readily perform the presetting without the need for dispatching a maintenance service man to the terminal system at the site. This therefore makes it possible to reduce the frequency of dispatches and to lower the dispatch cost.

BRIEF DESCRIPTION OF THE DRAWINGS

The above and other objects, features and advantages of the present invention will become apparent from the following description and the appended claims, taken in conjunction with the accompanying drawings, in which:

DETAILED DESCRIPTION OF THE INVENTION AND PREFERRED EMBODIMENT

One embodiment of the present invention will hereinafter be described with reference to FIGS. 3 and 4.

Figure 3:
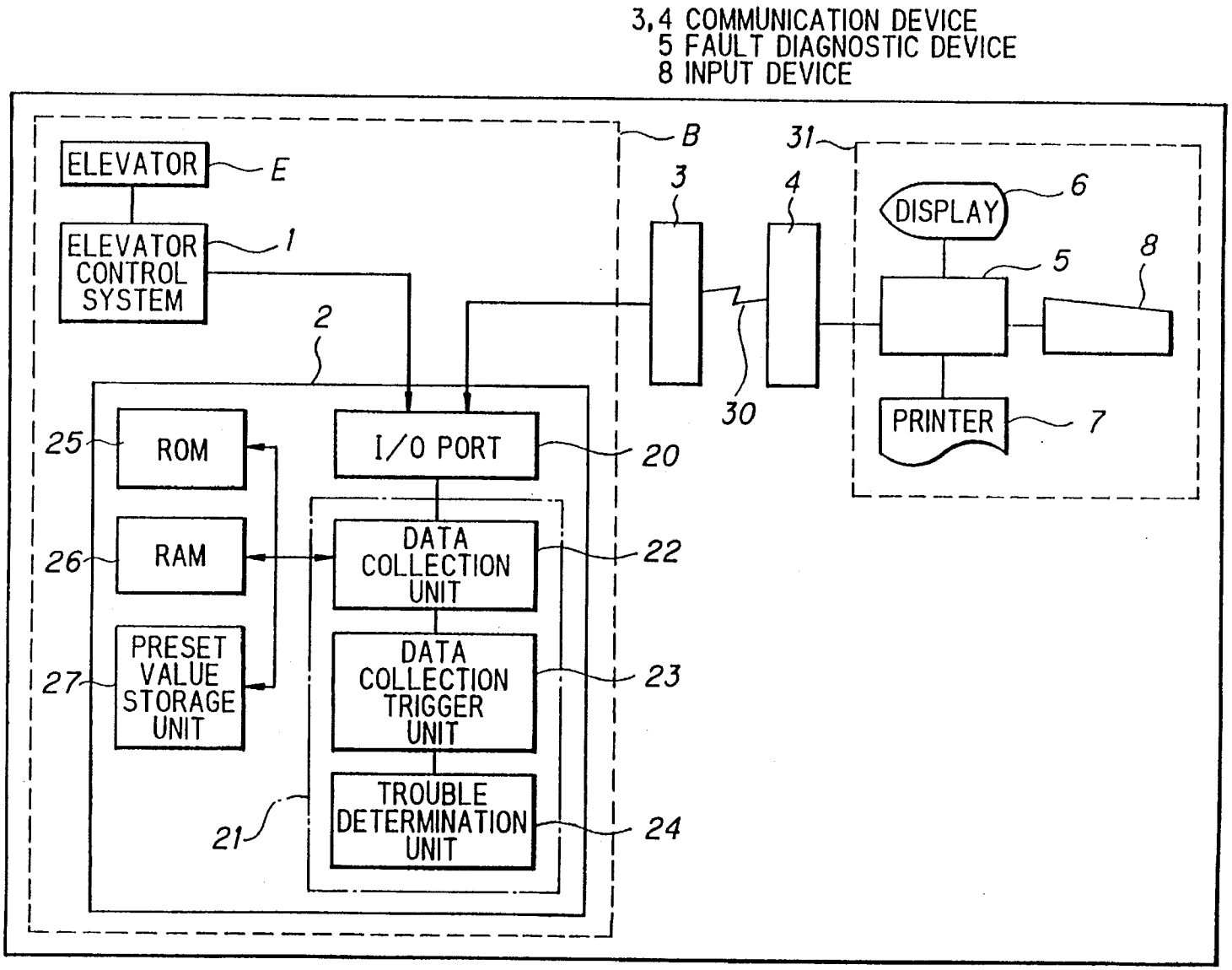
FIG. 3 is a block diagram showing the construction of one embodiment of the present invention.
Figure 4A:
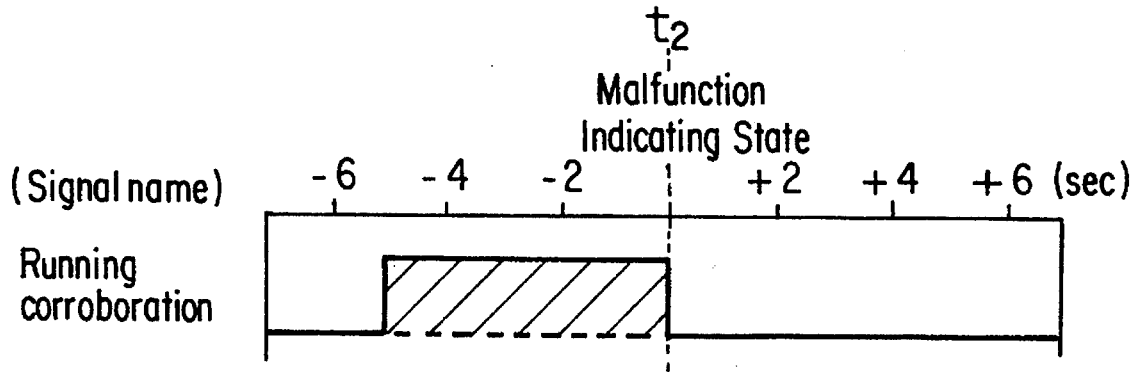
FIG. 4 is a time chart of data which are relevant to a trapped passenger malfunction and are inputted upon occurrence of a malfunction-indicating state.
Figure 4B:
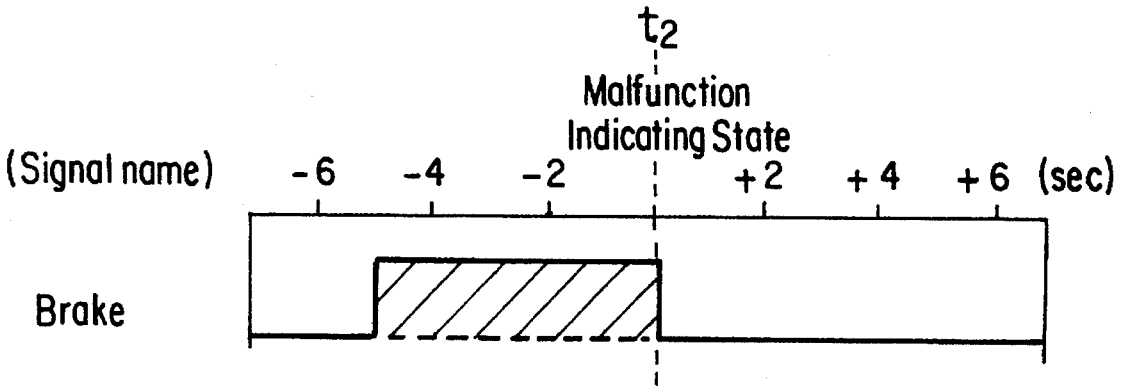
Figure 4C:
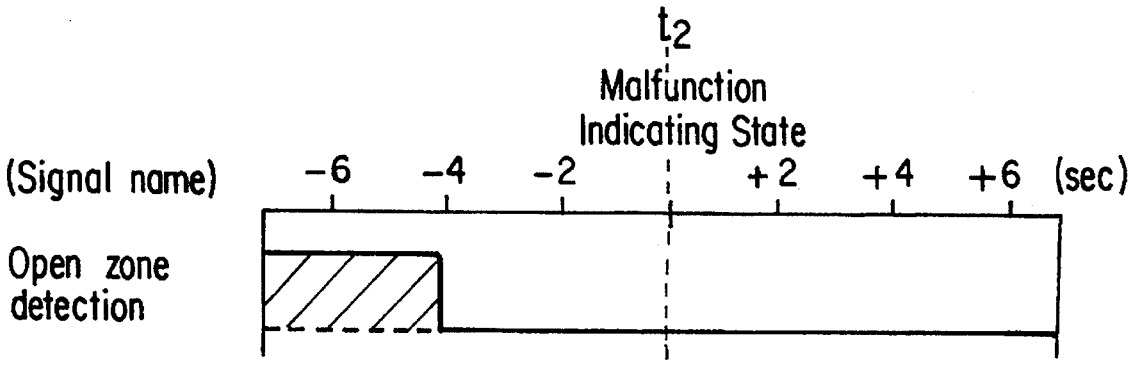
Figure 4D:
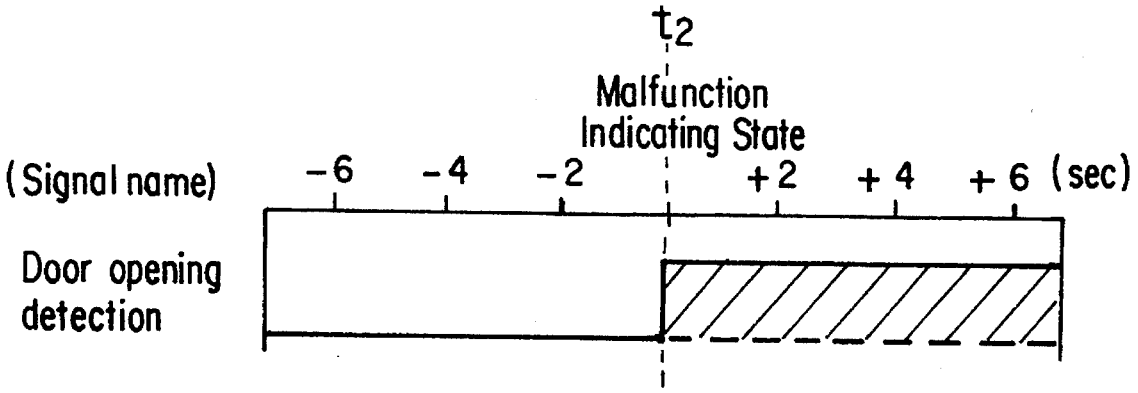
Figure 4E:
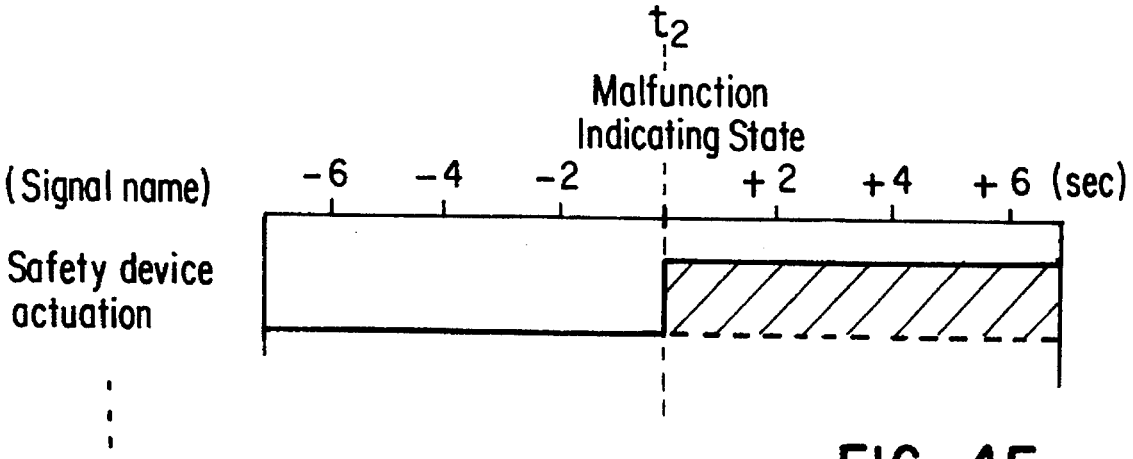

As is illustrated in FIG. 3, a terminal supervisor unit 2 is arranged in a building B in which an elevator E is installed. The terminal supervisor unit 2 is connected to an elevator control system 1 and a communication device 3. The elevator control system 1 controls the elevator E based on data from a car and also data from a pulse generator connected to a drive motor. The communication device 3 on a side of the building B is connected via a telephone line 30 to a communication device 4 on a side of a supervision center 31, the latter communication device 4 being connected to the supervision center 31.

The terminal supervisor device 2 comprises a microcomputer and is equipped with MPU 21 for controlling the overall operation, an input/output port 20 connected to the elevator control system 1 and the communication device 3 to perform input/output operation of signals, ROM 25 with a processing program stored for MPU 21, RAM 26 with data at the time of operation or control by MPU 21 stored readably therein, and a preset value storage unit 27 for storing preset values. Further, MPU 21 is provided with a data collection unit 22 having a data collecting function, a data collection trigger unit 23 having a function to drive the data collection unit 22 and a trouble determination unit 24 having a function to determine a malfunction on the basis of the collected data.

It is to be noted that the data collection unit 22, the data collection trigger unit 23 and the trouble determination unit 24 indicate in a readily comprehensible manner functions or means to be performed or operated as a result of an operation of MPU 21 in accordance with the program stored in ROM 25 and do not represent their structures themselves.

The supervision center 31 has a display 6 for displaying various data required for supervision, an input device 8 for performing an inputting operation and a printer 7 for printing out information on supervision. These components are connected to a fault diagnostic device 5 which diagnoses a malfunction on the basis of malfunction-reporting data from the terminal supervisor device 2. The fault diagnostic device 5 is connected to the above communication device 4.

An operation of this embodiment having such a construction as described above will be described with reference to FIG. 4, taking as an illustrative state of malfunction the case of occurrence of a trapped passenger malfunction in which passengers are confined to the elevator car.

Operational data of the elevator E, which have been inputted to the elevator control system 1, are successively stored in RAM 26 via the input/output port 20 and MPU 21. In accordance with the program of ROM 25, the data collection unit 22 in the MPU 21 reads "passenger detection" and "sudden stop during running" data from the data stored in RAM 26. The trouble determination unit 24 compares, as described above, the conditions preset for trapped passenger malfunction data and stored in ROM 25, that is, "passenger(s) in (the elevator)", "suddenly stopped during running" and "30 second elapsed" with the states of the above "passenger" data and "sudden stop during running" data.

In the present embodiment, the condition of "suddenly stopped during running" is preset and stored beforehand as a criterion for detecting a malfunction-indicating state. This is done from the input device 8 of the supervision center 31 to the preset value storage unit 27 by way of the fault diagnostic device 5, the communication device 4, the telephone line 30, the communication device 3, the input/output port 20 and MPU 21. This can be achieved by inputting the input device 8 with a signal indicating that the condition is the data to be stored in the preset value storage unit 27, a signal designating a predetermined storage region in the preset value storage unit 27 and a signal formed of data of "suddenly stopped during running" and then transmitting these signals to the terminal supervisor unit 2 through the telephone line 30.

MPU 21 constantly compares the above "sudden stop during running" data out of the data stored in RAM 26 with the condition of "suddenly stopped during running" preset in the preset value storage unit 27. At time $t_2$, the "sudden stop during running" data becomes the state of "suddenly stopped during running" (see FIG. 1) and hence becomes consistent with the condition preset at the preset value storage unit 27. The data collection trigger unit 23 is then driven to actuate the data collection unit 22. The data collection unit 22 then read from RAM 26 relevant data which were collected upon occurrence of the trapped passenger malfunction at time $t_2$ before time $t_3$ at which the malfunction had been determined. The data so read are stored at another region of RAM 26. The relevant data collected at time $t_2$ are shown in FIG. 4.

Figure 1A:
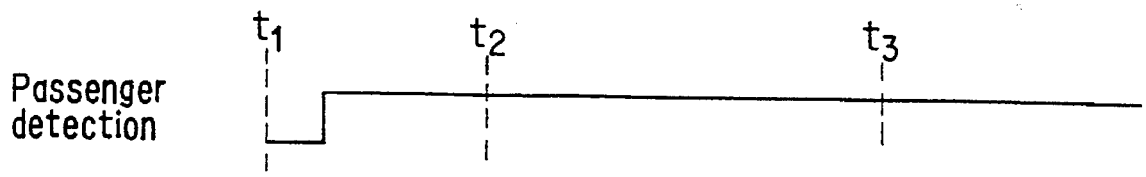
FIG. 1 is a time chart of criteria for detecting a "trapped passenger" malfunction.
Figure 1B:
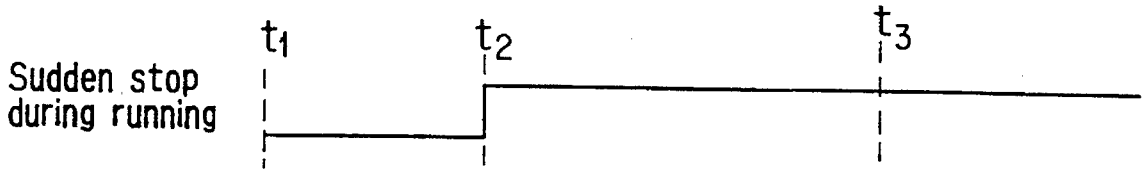
Figure 1C:
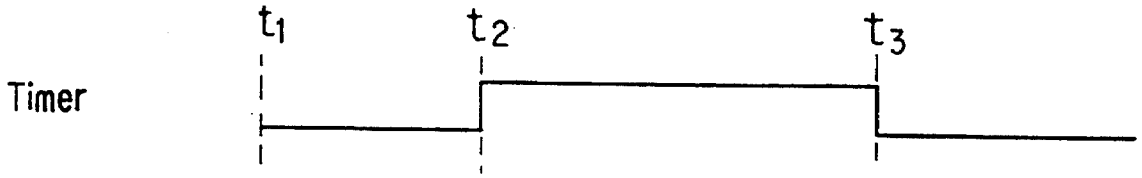
Figure 1D:
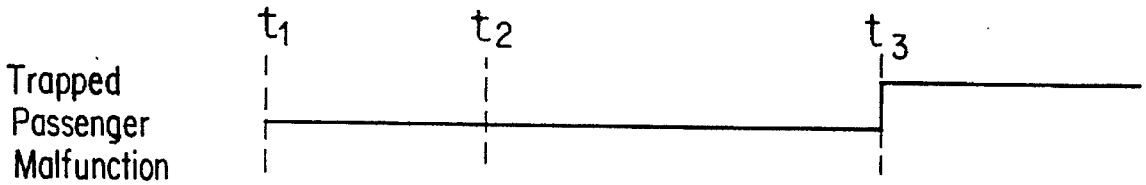
Figure 2:
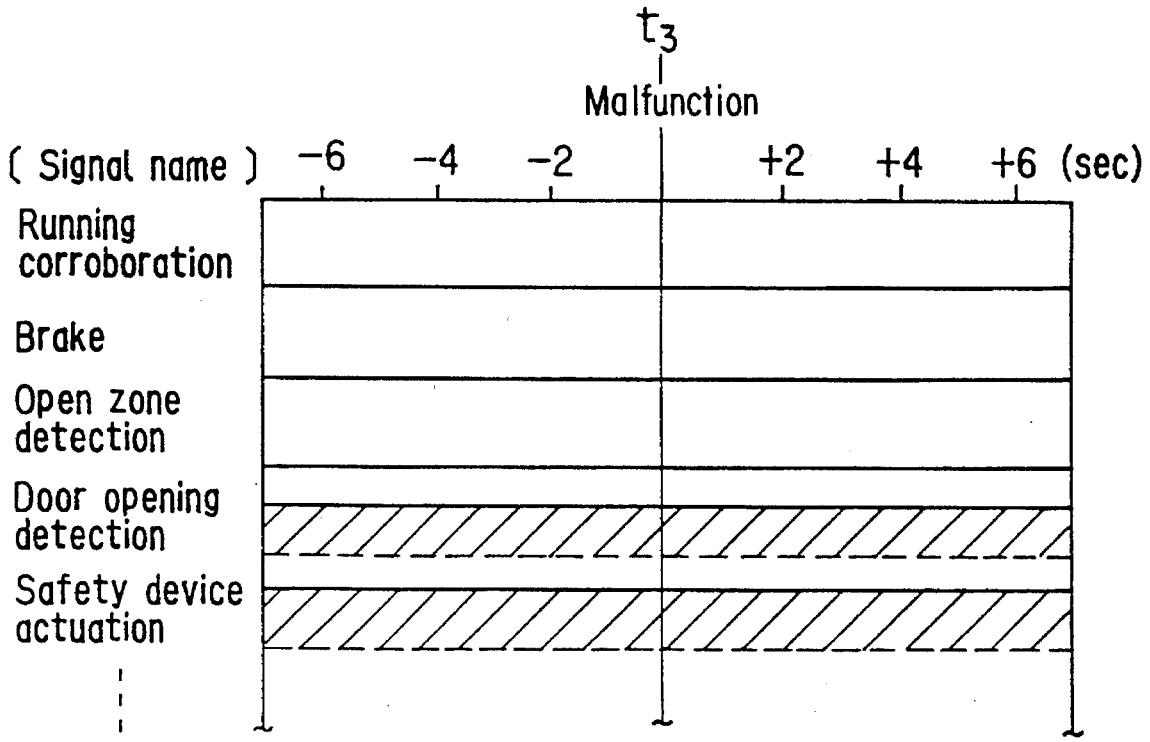
FIG. 2 PRIOR ART
FIG. 2 is a time chart illustrating data relevant to trapped passenger malfunction.

FIG. 4 shows the data actually collected by the system according to the invention upon the occurrence of a malfunction-indicating state (at time $t_2$). Note that although the names of the individual signals in FIG. 4 are the same as the signal names depicted in FIG. 2, the data themselves are clearly different from those collected by the prior art device, at time $t_3$. As depicted in FIG. 4, just prior to time $t_2$ the "Running Corroboration" signal indicates that the elevator is running and the "Brake" signal indicates that the brake is being applied, while the door is closed and the safety device is not actuated. At time $t_2$, the "Running Corroboration" signal changes from the running state to not running, thereby indicating a sudden stop during running, as noted previously. At the same time, $t_2$, the "Brake" signal transitions from high to low showing that the brake is released, the "Door Opening Detection Signal" shows that the door opens and the "Safety Device Actuation" signal shows that the Safety Device becomes actuated. If a malfunction is not actually detected within a predetermined time, these data collected at time $t_2$ will be discarded.

At time $t_3$ (not shown in FIG. 4) where the actual determination of a malfunction is made, the relevant data collected at time $t_2$ as described above are transmitted along with data such as the place of the occurrence of the malfunction, the code number of the elevator in question and the kind of the malfunction from MPU 21 to the supervision center 31 via the input/output port 20, the communication device 3, the telephone line 30 and the communication device 4. At the supervision center 31, the malfunction-reporting data is analyzed and diagnosed by the malfunction diagnostic device 5 and the results of the diagnosis are displayed at the display 6 and also printed out from the printer 8. An operator of the supervision center 31 becomes aware of the occurrence and site of a trapped passenger accident on the basis of the results of the diagnosis and immediately dispatches a maintenance service man or crew to make the maintenance service man or crew attend to recovery of the accident.

In the conventional system, the relevant data at time $t_3$ (as illustrated, for example, in FIG. 2) make it possible to conclude from the data indicative of "the actuation of the safety device" only that the trapped passenger malfunction occurred due to a certain cause which had led to the actuation of the safety device. In the present embodiment, on the other hand, the relevant data at time $t_2$ are transmitted as shown in FIG. 4, thereby making it possible to confirm that due to actuation of a door-open relay at a location outside the door open zone, the safety device was actuated and the elevator suddenly stopped during running. Further, it is also possible to estimate the cause for the actuation of the door-open relay on the basis of other data not shown in the time chart.

As has been described above, the present embodiment permits the collection of relevant data at a time before occurrence of a given malfunction, thus enabling an accurate analysis of the malfunction and its cause, by presetting and storing a set of conditions, which indicate a need for the investigation of the cause of a possible malfunction. These conditions are entered, in the preset value storage unit 27 from the supervision center 31 on the basis of experiences of previous maintenance work.

The present embodiment has been described on the basis of the case that a malfunction-indicating state is preset with respect to one of specific data ("sudden stop during running" data) relating to trapped passenger malfunctions. It should however be borne in mind that the present invention is not limited to the above embodiment. By determining specific data with respect to another malfunction and presetting and storing their conditions in the preset value storage unit, it is possible to analyze the malfunction and also to determine its cause likewise. Further, it is also possible, as needed, to choose plural pieces of specific data and preset malfunction-indicating states for them, respectively.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A data acquisition system for analyzing elevator malfunctions, of the type having an operational data storage unit for storing operation data of an elevator, malfunction determination means for determining occurrence of a malfunction of the elevator on the basis of data read from said operational data storage unit, and data collection means for reading data from said operational data storage unit, said data being relevant to said determination of a malfunction by said malfunction determination means; said operational data storage unit, malfunction determination means and data collection means being arranged in a terminal supervisor unit connected to a supervision center for supervising said elevator via a telephone line, said system further comprising:

a preset value storage unit for storing a set of criteria for determining existence of a malfunction-indicating state, in which occurrence of a malfunction of said elevator is likely to be imminent, but has not yet occurred;

means for presetting criteria for determining existence of a malfunction-indicating state in said preset value storage unit from said supervision center via said telephone line; and data collection trigger means for actuating said data collection means to read predetermined operational data from said operational data storage unit at a time, prior to actual occurrence of a malfunction, when data stored in said operational data storage unit correspond with said criteria preset for the determination of the malfunction-indicating state.

2. A data acquisition system according to claim 1, wherein the determination of a malfunction in said malfunction determination means is effected by continuation of existence of said predetermined criteria for a predetermined time.

3. Method of collecting data for analysis of a malfunction in an elevator unit comprising the steps of:

monitoring operational data of said elevator unit;

comparing monitored operational data with at least one predetermined set of data criteria for determining existence of a malfunction-indicating state, in which occurrence of a malfunction of said elevator unit is likely to be imminent, but has not yet occurred;

detecting existence of a malfunction-indicating state at a first point in time when at least part of said monitored operational data correspond with said predetermined set of data criteria;

storing said monitored operational data at said first point in time when said malfunction-indicating state is detected;

determining an existence of a malfunction based upon predetermined malfunction criteria, which malfunction is actually occurring at a second point in time after said storing step; and in response to said determining of an existence of a malfunction, reading said stored monitored operational data for analysis of a nature of said malfunction.

4. Method according to claim 3, wherein said step of reading said stored monitored operational data includes transmitting said stored monitored operational data to a remotely located supervision site for analysis of said malfunction at said remotely located supervision site.

5. Method according to claim 3, wherein said predetermined set of data conditions are preset through a remotely located supervision site.

6. Method according to claim 3, wherein the stored monitored operational data are erased if no malfunction is determined to exist within a predetermined time period following detection of said malfunction-indicating state.

* * * * *